United States Patent [19]

Ohuchi

[11] Patent Number: 5,024,196

[45] Date of Patent: Jun. 18, 1991

[54] IDLE SPEED ADJUSTING SYSTEM FOR INTERNAL COMBUSTION ENGINE

[75] Inventor: Hirofumi Ohuchi, Hyogo, Japan

[73] Assignee: Mitsubishi Denki Kabushiki Kaisha, Tokyo, Japan

[21] Appl. No.: 610,664

[22] Filed: Nov. 8, 1990

[30] Foreign Application Priority Data

Nov. 9, 1989 [JP] Japan ..... 1-293213

[51] Int. Cl.[5] ..... F02D 41/16

[52] U.S. Cl. ..... 123/339

[58] Field of Search ..... 123/339, 585, 588

[56] References Cited

U.S. PATENT DOCUMENTS

| | | | |
|---|---|---|---|
| 4,557,234 | 12/1985 | Ito | 123/339 |
| 4,612,889 | 9/1986 | Sugiura et al. | 123/339 |
| 4,617,890 | 10/1986 | Kobayashi et al. | 123/339 |
| 4,688,534 | 8/1987 | Takeda et al. | 123/339 |
| 4,716,871 | 1/1988 | Sakamoto et al. | 123/339 |
| 4,966,112 | 10/1990 | Shimomura | 123/339 |
| 4,986,236 | 1/1991 | Kobayashi | 123/339 |

FOREIGN PATENT DOCUMENTS 0016578 4/1988 Japan .

*Primary Examiner*—Willis R. Wolfe

*Attorney, Agent, or Firm*—Sughrue, Mion, Zinn, Macpeak and Seas

[57] ABSTRACT

An idle speed adjusting system for effecting feedback control of the idle speed of an internal combustion engine comprises a reference control amount output circuit for producing and delivering a reference control signal necessary for maintaining a command engine speed; a speed controller for generating a speed correction signal representing the offset of the running speed of the engine from the command engine speed; a flow rate controller for controlling the flow rate of intake air supplied to the engine, in accordance with the reference control signal and the speed correction signal; and an auxiliary flow rate controller for controlling the flow rate of the intake air in accordance with the speed correction signal and independently of the flow rate controller, so as to adjust the speed correction signal to a predetermined value. In the system, there is provided an ambient air temperature sensor for delivering an ambient air temperature signal to the reference control amount output circuit so as to vary the reference control signal in accordance with a change in the ambient air temperature.

3 Claims, 7 Drawing Sheets

IDLE SPEED ADJUSTING SYSTEM FOR INTERNAL COMBUSTION ENGINE

BACKGROUND OF THE INVENTION

1. Field of the Invention

The present invention relates to a system for adjusting the idle speed of an internal combustion engine through feedback control.

2. Description of the Related Art

In general, the flow rate of intake air taken into an internal combustion engine is closely related to the rate of supply of a fuel to the engine. It is known that the speed of running of the engine can be varied by varying the rate at which air is taken into the engine.

A known idle speed adjusting system for an internal combustion engine will be described with specific reference to FIG. 1. Referring to this figure, an internal combustion engine 1 has an intake pipe 2 which is provided with a throttle valve 3. A bypass intake passage 9 directly connects portions of the intake passage 2 upstream and downstream of the throttle valve 3 so as to bypass the throttle valve 3. More specifically, the bypass intake passage 9 includes a main bypass passage 91 and an auxiliary bypass passage 92 which are parallel to each other. The main bypass passage 91 has a linear solenoid valve 8 (referred to simply as "solenoid valve" hereinafter) capable of varying the cross-sectional area of the air passage in the main bypass passage 91 in accordance with the electrical current supplied thereto. Thus, the solenoid valve 8 functions as an intake air control valve. An adjusting screw 4 provided in the auxiliary bypass passage 92 is capable of varying the cross-sectional area of the air passage so as to control the flow rate of air flowing through the auxiliary bypass passage 92. The solenoid valve 8 is arranged so as to be driven and controlled by the output of an actuator 7.

On the other hand, a gear 41 provided on the shaft of the internal combustion engine 1 rotates as the engine operates, and the rotation of this gear 41 is sensed by a rotation speed sensor 42. The rotation speed sensor 42 detects the rotation speed of the gear 41 and delivers the engine speed $n_E$ to an offset amplifier 61. The offset amplifier 61 also receives a command speed $n_T$ from a command speed generator 5. The offset amplifier 61 computes the offset $\Delta n$ of the engine speed $n_E$ from the command speed $n_T$ and delivers it to a speed controller 62. The command speed generator 5 generates, in accordance with conditions such as the engine temperature, a predetermined idle speed as the command speed $n_T$. The speed controller 62, upon receipt of the speed offset $\Delta n$, conducts a proportional, integrating or differentiation operation so as to generate a speed correction signal $S_C$ which acts in the direction to cancel the speed offset $\Delta n$. Meanwhile, a reference control amount output circuit 11 delivers a reference control signal $S_T$ representing a fixed control amount to maintain the engine speed $n_E$ at the same level as the command speed $n_T$. An adder 13 adds this reference control signal $S_T$ to the output $S_C$ from the speed controller 62, and delivers the sum as an output. The output $(S_T+S_C)$ of the adder 13 is delivered to a limiter 12, which delivers a signal representing a limited value within the range of $(S_T+S_C)$. The output from the limiter 12 is delivered to the actuator 7 which delivers to the solenoid valve 8, upon receipt of the output from the limiter 12, an actuating signal of a duty cycle corresponding to the input signal. The solenoid valve 8 then increases or decreases the cross-sectional area of the air passage, thereby controlling the flow rate of air flowing through the bypass intake passage 9.

A description will now be given of the operation of this system. The speed controller 62 operates in accordance with the speed offset $\Delta n$, thereby generating a speed correction signal $S_C$. This speed correction signal $S_C$ varies in such a direction as to reduce the speed offset $\Delta n$ which is output from the offset amplifier 61, and is settled when the speed offset $\Delta n$ is minimized. The adder 13 adds the output $S_C$ of the speed controller 62 to the output $S_T$ from the reference control output circuit 11 and delivers the sum to the limiter 12. The limiter 12 delivers a limited output to the actuator 7 which in turn produces an actuating signal for actuating the solenoid valve 8.

The idle speed is adjusted in a manner which will be explained hereinunder. It is assumed here that the throttle valve 3 is in the idle position and the control is conducted when the engine is sufficiently warmed up. A correction value output circuit 20 converts the speed correction signal $S_C$ from the speed controller 62 into a duty cycle signal as shown in FIG. 2, and delivers this signal to an externally connected meter 21. The meter 21 is a volt meter capable of indicating a value corresponding to the mean voltage. The adjusting screw 4 on the bypass intake passage 9 is then manually adjusted such that the meter indicates a value corresponding to a 50% duty ratio. Consequently, the speed correction signal $S_C$ is reduced to zero, whereby the offset of the idle speed is eliminated regardless of the causes of the offset, e.g., clogging of the throttle valve 3 or of the solenoid valve 8, and so forth.

A description will now be given of another known idle speed adjusting system for an internal combustion engine, with specific reference to FIG. 3. In FIG. 3, the same reference numerals are used to denote the same components as those appearing in FIG. 1, and detailed description of such components is omitted. The engine speed $n_E$ sensed by the speed sensor 42 is delivered not only to the offset amplifier 61 but also to an engine speed meter 60. The limiter 12 delivers a signal of a value within a limited range in response to the input value $(S_T+S_C)$, in accordance with the operations of the command speed generator 5, the offset amplifier 61, the speed controller 62, the reference control amount output circuit 11 and the adder 13. A switching circuit 15 selects the output of the limiter 12 when the idle speed adjusting switch 14 is off, whereas, when the idle speed adjusting switch 14 is on, it selects the output $S_T$ from the reference control amount output circuit 11. The output selected by the switching circuit 15, i.e., the output from the limiter 12, or the output from the reference control amount output circuit 11, is delivered to the actuator 7 which, in accordance with the selected output, delivers to the solenoid valve 8 a duty cycle signal corresponding to the selected output. In consquence, the solenoid valve 8 controls the cross-sectional area of the air passage so as to increase and decrease the flow rate of the intake air flowing through the bypass intake passage 9. The idle speed adjusting switch 14 applies a predetermined signal to the input terminal of the switching circuit 15.

A description will now be given of the operation of this system. The speed controller 62 operates in accordance with the speed offset $\Delta n$, so as to produce a speed correction signal $S_C$. The speed correction signal $S_C$ is generated in such a direction as to reduce the offset $\Delta n$ which is output from the offset amplifier 61, and is settled when the offset $\Delta n$ is minimized. The output $S_C$ of the speed controller 62 is added by the adder 13 to the output $S_T$ of the reference control amount output circuit 11 and the sum is delivered to the limiter 12. Either the output of the reference control amount output circuit 11 or the output of the limiter 12 is delivered to the actuator 7 in response to the ON or OFF of the idle adjusting switch 14, and is converted to an actuating signal for actuating the solenoid valve 8.

The manner in which the idle speed is adjusted in this system will be described with reference to FIG. 3. The adjustment of the idle speed is conducted, for example, when the engine has been sufficiently warmed up, with the throttle valve 3 being set at the idle position. A mechanic then turns on the idle adjusting switch 14. As a consequence, the reference control signal $S_T$ from the reference control amount output circuit 11 is selected by the switching circuit 15 and is then delivered to the actuator 7. The actuator 7 delivers an actuating signal of a duty cycle corresponding to the level of the reference control signal $S_T$ to the solenoid valve 8 so as to set the solenoid valve 8 to a reference degree of opening. On the other hand, the engine speed meter 60 receiving a signal output which indicates the engine speed $n_E$ from an engine speed sensor 42. In this state, the mechanic manually adjusts the adjusting screw 4 to adjust the intake airflow rate through the auxiliary bypass intake passage, while monitoring the engine speed meter 60, thereby setting the engine speed $n_E$ to a predetermined speed.

In the known idle speed adjusting systems having the described constructions, the intake air flow rate varies according to the value of the electrical current flowing through the linear solenoid of the solenoid valve 8. The electrical current through the linear solenoid varies according to the electrical resistance of the linear solenoid which varies according to the ambient air temperature. This poses the following problem. If the idle speed is adjusted when the ambient air temperature is high, since the linear solenoid of the solenoid valve 8 exhibits a large resistance, the intake air flow rate is decreases, requiring the adjusting screw to be opened more than when the adjustment is conducted at a lower ambient air temperature. Therefore, when the air temperature drops, the electrical resistance of the linear solenoid of the solenoid valve 8 is changed to cause a change in the intake air flow rate. In such a case, though a demand for closing the intake air control valve exists for the purpose of maintaining the idle speed at the command level, the control of the intake air flow rate may be defective after the solenoid valve 8 is at its lower limit of control. Consequently, the idling speed is set at a higher rate than the command idle speed, resulting in an uneconomical use of fuel.

SUMMARY OF THE INVENTION

Accordingly, an object of the present invention is to provide an idle speed adjusting system for an internal combustion engine which is capable of enabling an idle speed to be maintained at a set speed regardless of the temperature of the ambient air in which the adjustment is conducted.

According to one aspect of the invention, there is provided an idle speed adjusting system in which the flow rate of intake air introduced into an internal combustion engine is controlled in accordance with a reference control signal and a speed correction signal and, independently of this control, the intake air flow rate is controlled also in such a manner that the speed correction signal or a signal relating thereto is set at a predetermined level, wherein the ambient air is directly or indirectly sensed and the reference control signal is varied in accordance with the sensed change in the ambient air temperature.

A second aspect of the present invention, provides an idle speed adjusting system in which the ambient air temperature is directly or indirectly sensed and either a standard control signal of a level corresponding to the ambient air temperature or a signal obtained by correcting the reference control signal is selected, the selected signal being applied to a flow rate control means thereby controlling the flow rate of the intake air supplied to the engine, wherein the improvement comprises flow rate control means for controlling the flow rate of the intake air only when the reference control signal is selected.

According to the first aspect of the invention, any change in the intake air flow rate taken into the internal combustion engine is adjusted while outputting the reference control signal, which is caused by a change in the electrical current value in the linear solenoid due to a change in the electrical resistance of the linear solenoid caused by a change in the ambient air temperature, which is varied in accordance with a change in the ambient air temperature. Therefore, even when the resistance of the linear solenoid of the flow rate control means is varied due to a change in the ambient air temperature after the adjustment is made, the flow rate control is conducted within the controllable range of the flow rate control means, so that the idle speed is maintained at the command level.

According to the second aspect of the invention, any change in the intake air flow rate, which is caused by a change in the electrical current value in the linear solenoid due to a change in the electrical resistance of the linear solenoid caused by a change in the ambient air temperature, can be compensated for by the selection of the standard control signal corresponding to the ambient air temperature. Thus, the degree of opening of the flow rate control means is set to a value corresponding to the ambient air temperature, when the adjustment of the idle speed is conducted. The degree of opening of the flow rate control means is effected in this state so as to maintain a desired command speed.

As has been described, according to the present invention, the intake air flow rate is adjusted independently of the operation of the flow rate control means, under such a condition that a reference control signal corresponding to the ambient air temperature is supplied to the flow rate control means so as to specify the intake air flow rate. It is therefore possible to maintain the idle speed constantly at the command idle speed and, hence, to improve fuel economy, even when the ambient air temperature varies after adjustment of the idle speed.

The above and other objects, features and advantages of the present invention will become clear from the following description of the preferred embodiments when taken in conjunction with the accompanying drawings.

DESCRIPTION OF THE PREFERRED EMBODIMENTS

Figure 1:
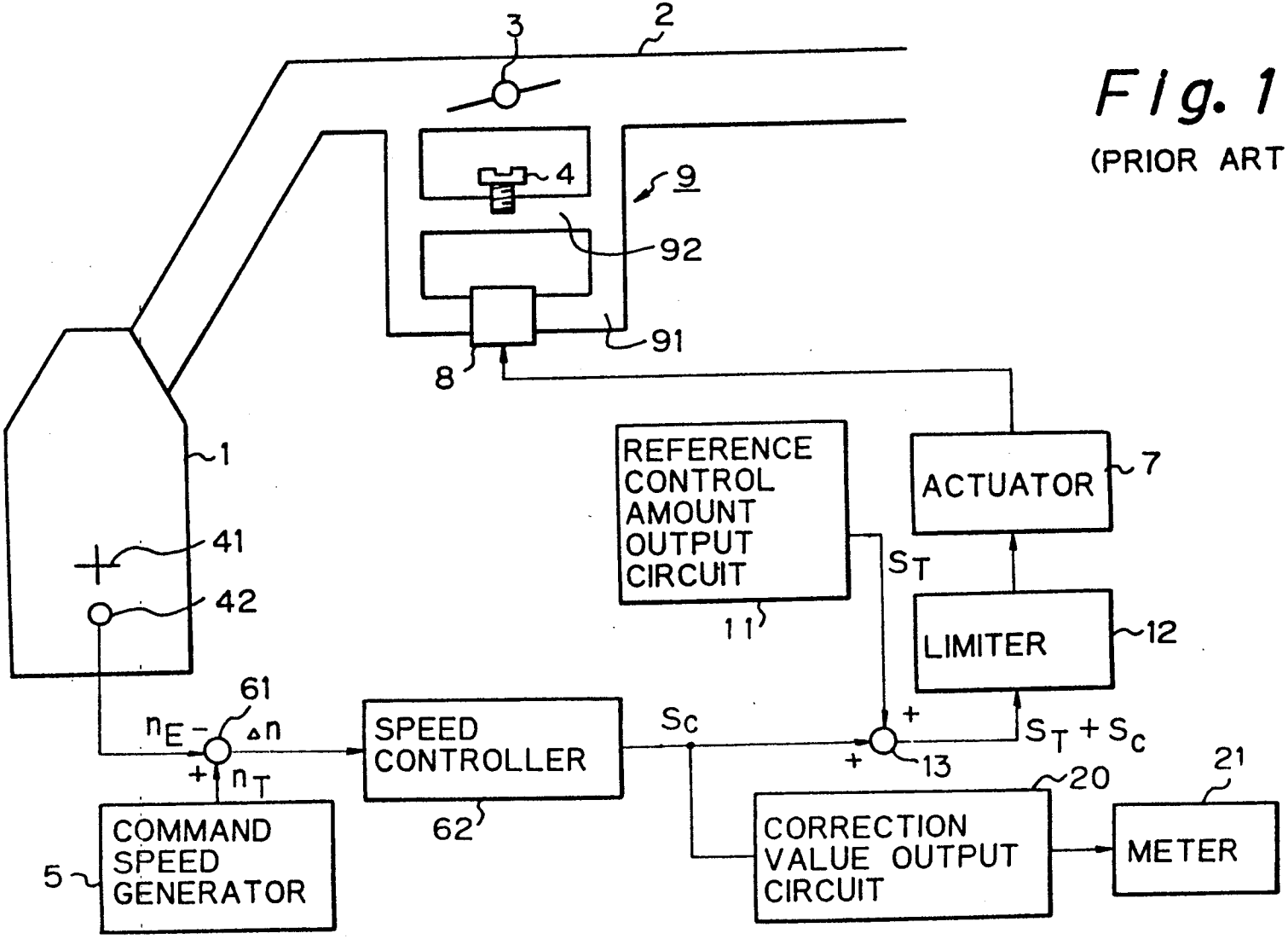
Fig. 1 (PRIOR ART)
FIG. 1 is an illustration of a known system for adjusting the idle speed of an internal combustion engine.
Figure 2:
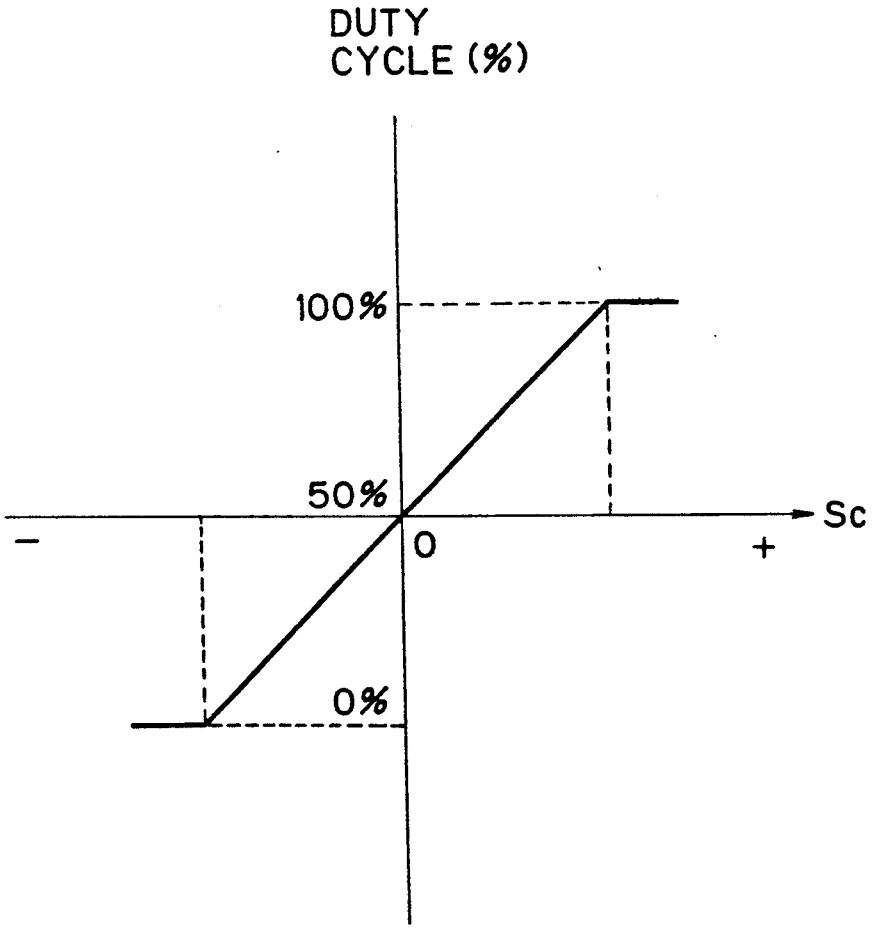
Fig. 2 PRIOR ART
FIG. 2 is a chart showing input/output characteristics of a correction value output circuit.

Preferred embodiments of the present invention will be described with reference to the drawings. A first embodiment will be described with reference to FIG. 4. In this figure, numeral 1 to 5, 7 to 9, 12, 13, 20, 21, 41, 42, 61, 62, 91 and 92 denote the same components as those appearing in FIG. 1, and detailed description of such parts or members is omitted. An ambient air temperature sensor 10, composed of, for example, a thermistor, produces an ambient air temperature signal $T_a$ of a level corresponding to the ambient air temperature. Upon receipt of the ambient air temperature signal $T_a$, a reference control amount output circuit 11A produces a reference control signal $S_{TV}$ the level of which becomes lower as the ambient air temperature becomes lower as shown in FIG. 5. The reference control signal $S_{TV}$ is a reference signal which is necessary for maintaining the idle speed at the command level. For instance, therefore, the reference control signal $S_{TV}$ is determined to maintain the intake air flow rate substantially constant regardless of the ambient air temperature, i.e., irrespective of the temperature of the linear solenoid of the solenoid valve 8. The adder 13 delivers the sum of the output $S_C$ of the speed controller 62 and the output $S_{TV}$ of the reference control amount output circuit 11A to the limiter 12.

Figure 5:
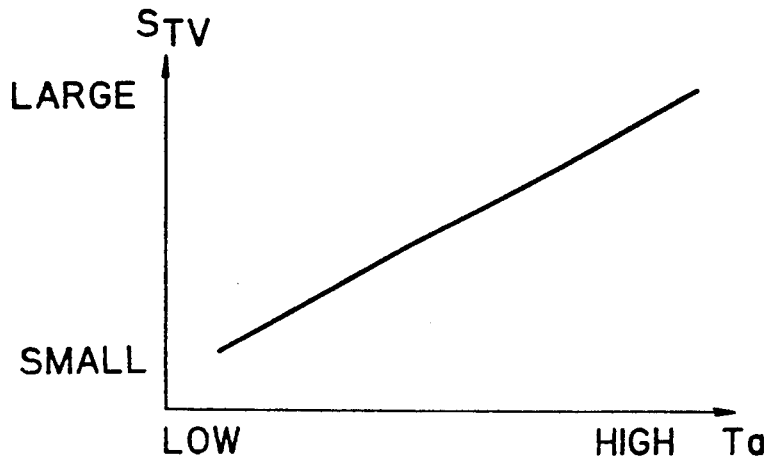
FIG. 5 is a chart showing input/output characteristics of a reference control amount output circuit in the embodiment shown in FIG. 4.
Figure 6:
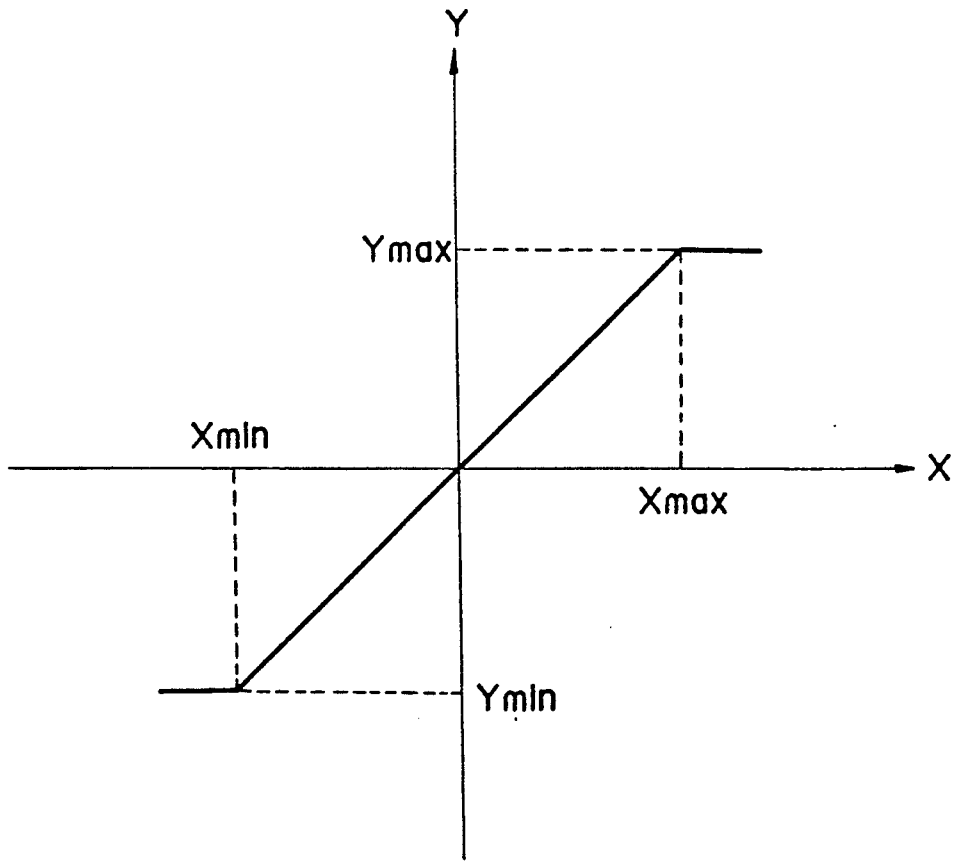
FIG. 6 is a chart showing input/output characteristics of a limiter in the embodiment shown in FIG. 4.
Figure 7:
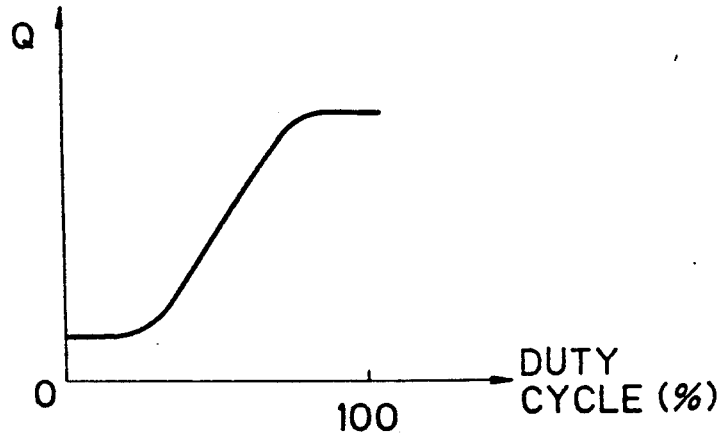
FIG. 7 is a graph showing the relationship between the duty cycle signal and the amount of control of intake air in the embodiment shown in FIG. 4.

A description will now be given of the operation of this embodiment, with reference to FIG. 4. The ambient air temperature sensor 10 directly or indirectly senses the temperature of the ambient air and outputs an ambient air temperature signal $T_a$ of a level proportional to the ambient air temperature. The reference control amount output circuit 11A receives the ambient air temperature signal $T_a$ from the sensor 10 and produces the reference control signal $S_{TV}$ proportional to the level of the ambient air temperature signal $T_a$ as will be seen from FIG. 5. The level of the reference control signal $S_{TV}$ varies according to the ambient air temperature, such that the reference opening degree of the solenoid valve 8 increases as the ambient air temperature rises. Meanwhile, a speed correction signal $S_C$ is obtained from the speed controller 62, in accordance with an output from the offset amplifier 61 which receives output signals from the speed sensor 42 and the command speed generator 5. The adder 13 delivers to the limiter 12 the sum of the reference control signal $S_{TV}$ derived from the reference control amount output circuit 11A and the speed correction signal $S_C$ from the speed controller 62. The limiter 12 has an operation characteristic as shown in FIG. 6. Namely, when the input X meets the condition of $X_{min}<X<X_{max}$, the limiter produces an output Y which is proportional to the input X. When the above-mentioned condition is not met, the limiter 12 outputs a limit value $Y_{min}$ or $Y_{max}$. The output of the limiter 12 is converted to an actuating signal which is to be applied by the actuator 7 to the solenoid valve 8 as the intake control valve. This actuating signal is a duty cycle signal. A relationship as shown in FIG. 7 exists between the duty cycle and the intake control amount Q. Thus, the increase and decrease of the intake air flow rate is controlled by increasing and decreasing the duty cycle.

Thus, the speed control signal $(S_{TV}+S_C)$ serves to effect such a control as to minimize the speed offset $\Delta n$ thereby making the engine speed $n_E$ substantially approximate the command speed $n_T$. This is because the speed control signal $(S_{TV}+S_C)$ adjusts the variation of the load caused by various factors such as a fluctuation in the intake air flow rate and other factors of the engine operation due variation in the ambient air temperature, variation in the thermal efficiency due to a change in the ambient air temperature, and variation in the load level due to variation of operating conditions of electrical appliances such as lamps and motors. In the event of a failure in the speed sensor 42 or the ambient air temperature sensor 10, the speed control signal $(S_{TV}+S_C)$ may diverge due to lack of feedback. The limiter 12 has a function to limit the value of the speed control signal $(S_{TV}+S_C)$ so as to prevent divergence of this signal, thereby preventing the engine speed from becoming out of control.

Figure 4:
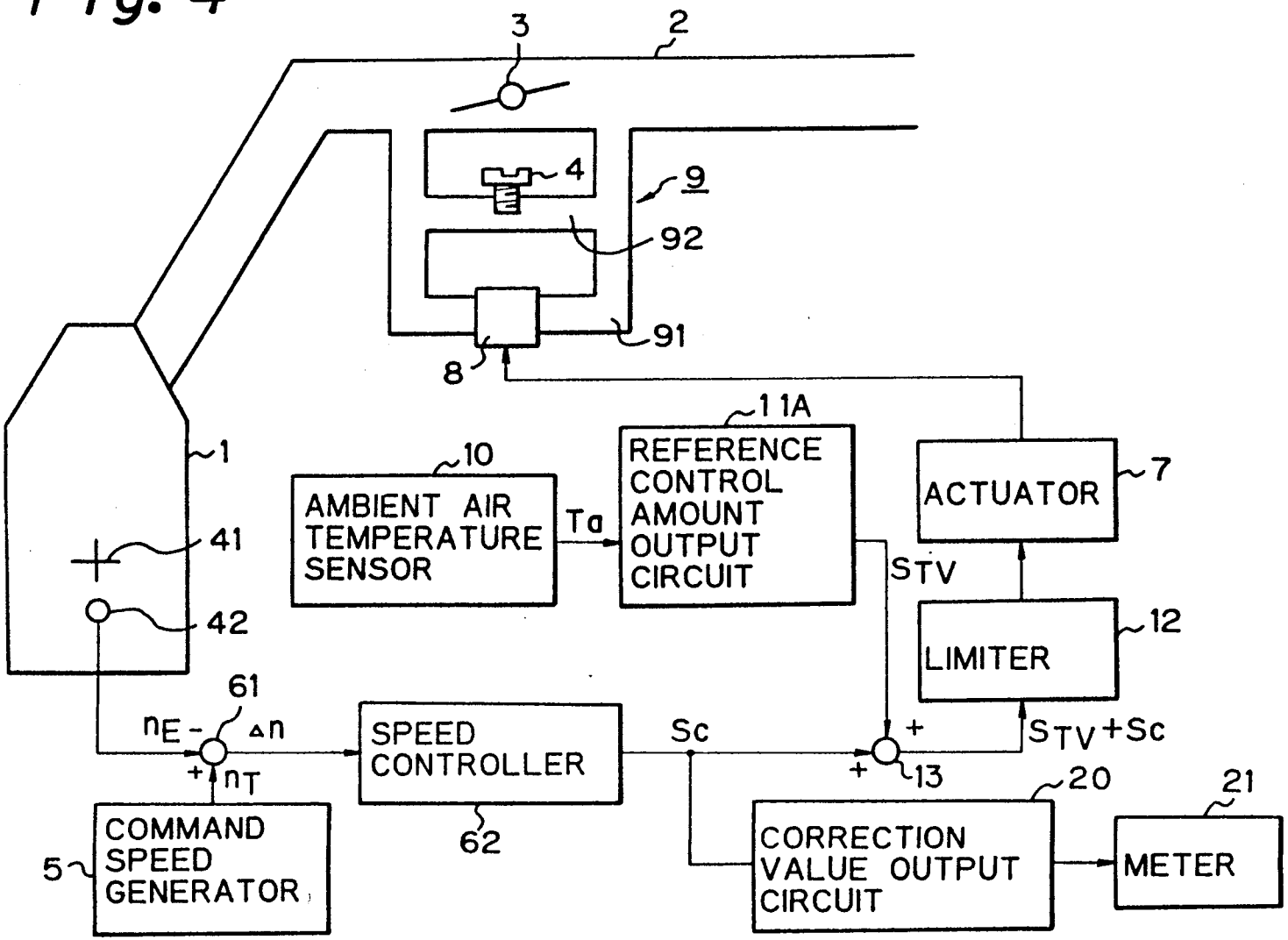
FIG. 4 is an illustration of an embodiment of the idle speed adjusting system for an internal combustion engine in accordance with the present invention.

The adjusting operation in this system shown in FIG. 4 will be obvious from the description of the adjusting operation in the known system explained before in connection with FIG. 1. The description, therefore, will focus to a novel feature of this embodiment. The reference control signal $S_{TV}$, which is output from the reference control amount output circuit 11A and which is suited to the ambient air temperature, functions to control the opening of the solenoid valve 8 so as to maintain a substantially constant flow rate of the intake air regardless of a change in the ambient air temperature. Since the adjusting screw 4 is operated under such a condition, the feedback control of the solenoid valve 8 is conducted only with the controllable range of the solenoid valve 8, even when the ambient air temperature is changed after the adjustment.

Figure 8:
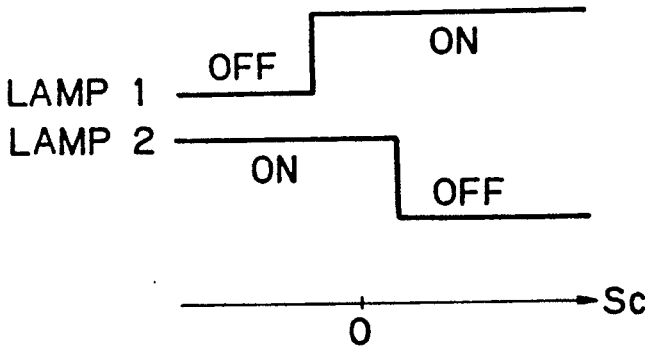
FIG. 8 is an illustration of another embodiment of the idle speed adjusting system for an internal combustion engine, illustrating particularly the state of lighting of a lamp.

Although a volt meter is used in the adjustment of the idle speed in the described embodiment, this is only illustrative and the arrangement may be such that, as shown in FIG. 8, a pair of lamp circuits are used to instruct an adjustment for a higher idle speed and an adjustment for a lower idle speed.

The speed correction signal $S_C$ output from the correction value output circuit 20 may be a coded signal. When the idle speed adjustment is performed by a computer, data corresponding to such a coded signal being stored in a memory for storing the correction signal $S_C$.

Figure 9:
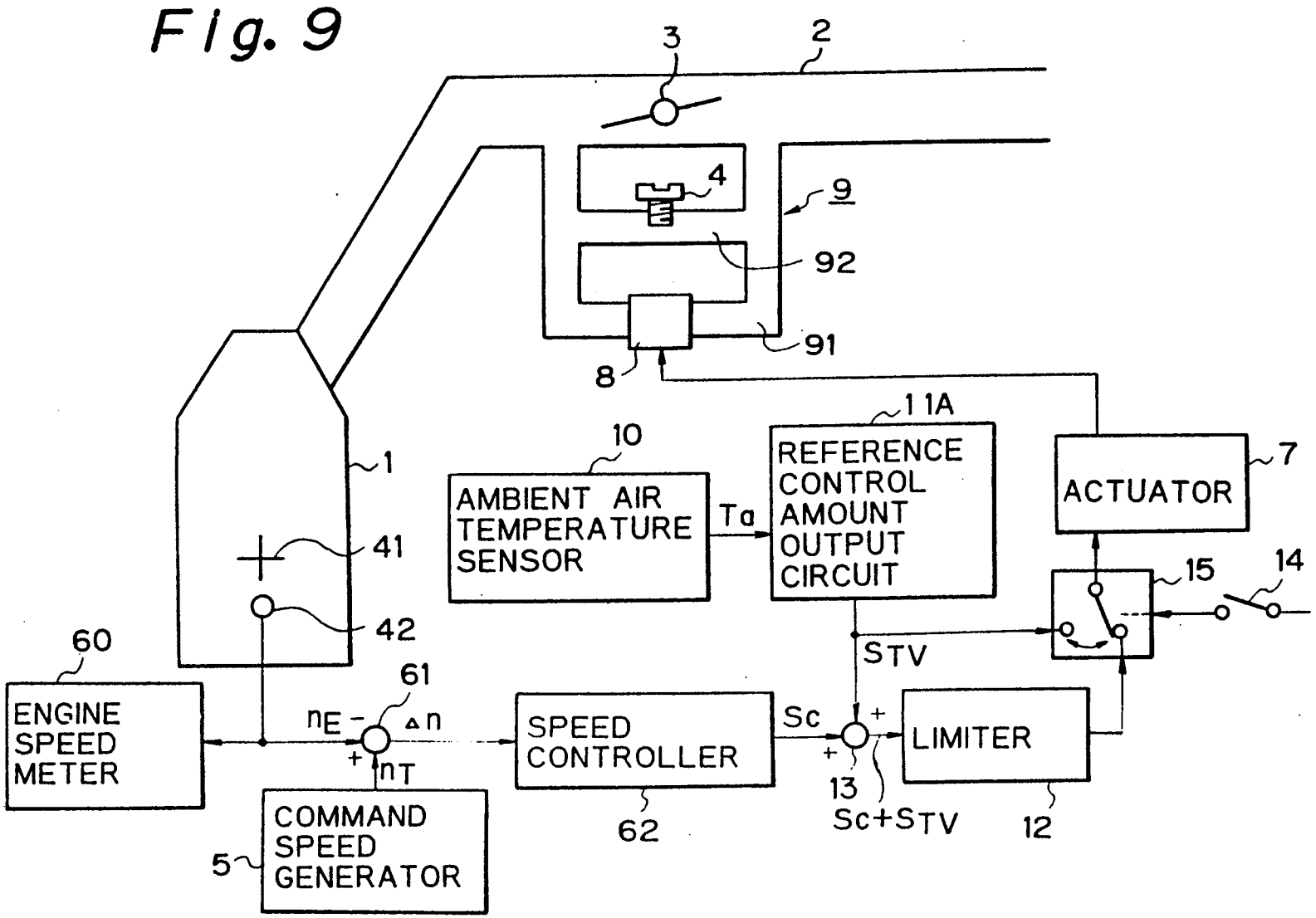
FIG. 9 is an illustration of still another embodiment of the idle speed adjusting system for an internal combustion engine.

Another embodiment of the present invention will be described with reference to FIG. 9. In this figure, numerals 1 to 5, 7 to 9, 12, 13, 20, 21, 41, 42, 60 to 62, 91 and 92 denote the same components as those in FIG. 3 and detailed description of such components is omitted.

An ambient air temperature sensor 10, composed of, for example, a thermistor, produces an ambient air temperature signal $T_a$ of a level corresponding to the ambient air temperature. Upon receipt of the ambient air temperature signal $T_a$, a reference control amount output circuit 11A produces a reference control signal $S_{TV}$ the level of which becomes lower as the ambient air temperature becomes lower as shown in FIG. 5. The reference control signal $S_{TV}$ is a reference signal which is necessary for maintaining the idle speed at the command level. For instance, therefore, the reference control signal $S_{TV}$ is determined to maintain the intake air flow rate substantially constant regardless of the ambient air temperature, i.e., irrespective of the temperature of the linear solenoid of the solenoid valve 8. The adder 13 delivers the sum of the output $S_C$ of the speed controller 62 and the output $S_{TV}$ of the reference control amount output circuit 11A to the limiter 12. A switching circuit 15 is for selecting either the output of the reference control amount output circuit 11A or the output of the limiter 12 in accordance with the state, i.e., on or off, of the idle adjusting switch 14.

Description will now be made of the operation of this embodiment, with reference to FIG. 9. The ambient air temperature sensor 10 directly or indirectly senses the temperature of the ambient air and outputs an ambient air temperature signal $T_a$ of a level proportional to the ambient air temperature. The reference control amount output circuit 11A receives the ambient air temperature signal $T_a$ from the sensor 10 and produces the reference control signal $S_{TV}$ proportional to the level of the ambient air temperature signal $T_a$ as will be seen from FIG. 5. The level of the reference control signal $S_{TV}$ varies according to the ambient air temperature, such that the reference opening degree of the solenoid valve 8 increases as the ambient air temperature rises. Meanwhile, a speed correction signal $S_C$ is obtained from the speed controller 62, in accordance with an output from the offset amplifier 61 which receives output signals from the speed sensor 42 and the command speed generator 5. The adder 13 delivers to the limiter 12 the sum of the reference control signal $S_{TV}$ derived from the reference control amount output circuit 11A and the speed correction signal $S_C$ from the speed controller 62. The limiter 12 has an operation characteristic which is the same as that shown in FIG. 6. When the idle adjusting switch 14 is on, the switching circuit 15 selects the output $S_{TV}$ from the reference control amount output circuit 11A, whereas, when the idle adjusting switch 14 is off, it selects the output from the limiter 12. The selected signal is converted to an actuating signal which is to be applied by the actuator 7 to the solenoid valve 8 as the intake control valve. This actuating signal is a duty cycle signal. A relationship as shown in FIG. 7 exists between the duty cycle and the intake control amount Q. Thus, the increase and decrease of the intake air flow rate is controlled by increasing and decreasing the duty cycle.

Thus, the speed control signal ($S_{TV}+S_C$) serves to effect such a control as to minimize the speed offset $\Delta n$, thereby making the engine speed $n_E$ substantially the same as to the command speed $n_T$. This is because the speed control signal ($S_{TV}+S_C$) adjusts the variation of the load caused by various factors such as a fluctuation in the intake air flow rate and other factors affecting the engine operation such as variation in the ambient air temperature, variation in the thermal efficiency due to a change in the ambient air temperature, and variation in the load level due to variation of operating conditions of electrical appliances such as lamps and motors.

Figure 3:
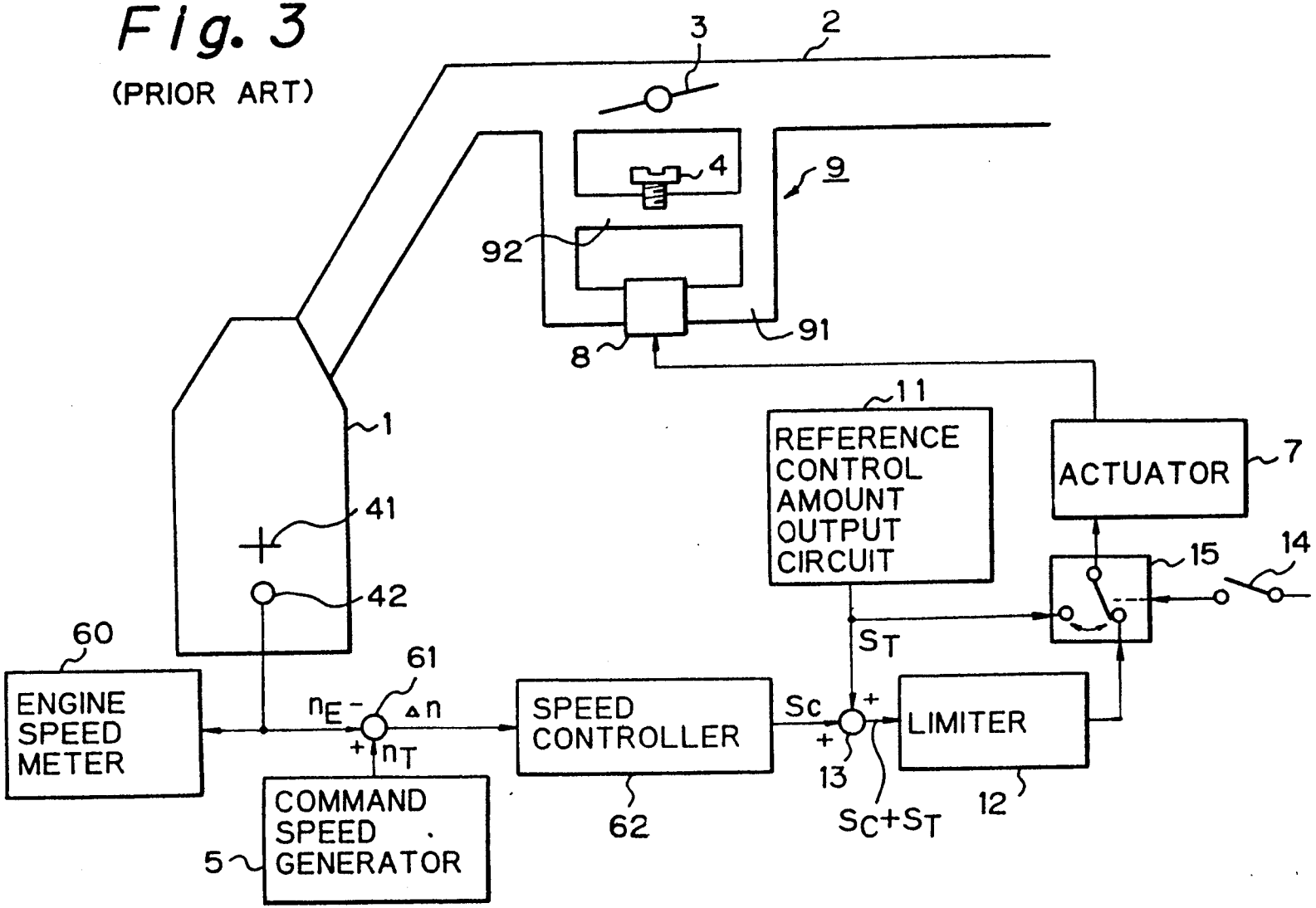
Fig. 3 (PRIOR ART)
FIG. 3 is an illustration of another known idle speed adjusting system for an internal combustion engine.

The idle speed adjusting operation in this embodiment will be obvious from the description of adjusting operation of the known system taken in conjunction with FIG. 3, so that a brief explanation will be sufficient to make the operation understood. The reference control signal $S_{TV}$ derived from the reference control amount output circuit 11A is proportional to the ambient air temperature. This signal is selected by the switching circuit 15 and is delivered to the actuator 7 when the idle adjusting switch 14 is on. As a consequence, the reference opening degree of the solenoid valve 8, which is actuated by the actuator 7, varies according to the ambient air temperature, so that the reference opening, i.e., the cross-sectional area of the main bypass passage 91, increases as the ambient air temperature rises. It is therefore possible to adjust the adjusting screw 4 in the same manner as that in the conventional systems, while maintaining the intake air flow rate substantially constant regardless of the ambient air temperature.

In the embodiments described hereinbefore, the ambient air temperature is sensed by the ambient air temperature sensor. This, however, is only illustrative and the ambient air temperature sensor may be substituted by an intake air sensor capable of sensing the temperature of the intake air introduced into the internal combustion engine.

What is claimed is:

1. An idle speed adjusting system for effecting feedback control of the idle speed of an internal combustion engine, comprising:

reference control amount output circuit means for producing and delivering a reference control signal necessary for maintaining a command engine speed;

speed control means for generating a speed correction signal representing the offset of the running speed of said engine from said command engine speed;

flow rate control means for controlling the flow rate of intake air supplied to said engine, in accordance with said reference control signal and said speed correction signal;

auxiliary flow rate control means for controlling the flow rate of the intake air in accordance with said speed correction signal and independently of said flow rate control means, so as to adjust said speed correction signal to a predetermined value; and ambient air temperature sensing means for delivering an ambient air temperature signal to said reference control amount output circuit means so as to vary said reference control signal in accordance with a change in the ambient air temperature.

2. A system according to claim 1, wherein said flow rate control means includes actuating means for generating an actuating signal having a duty cycle corresponding to the signal supplied to said actuating means, and solenoid valve means operated in accordance with the actuating signal, and wherein said predetermined value of said speed correction signal is a zero value corresponding to 50% in terms of the duty ratio of said duty cycle.

3. An idle speed adjusting system for effecting feedback control of the idle speed of an internal combustion engine, comprising:

reference control amount output circuit means for producing and delivering a reference control signal necessary for maintaining a command engine speed;

speed control means for generating a speed correction signal representing the offset of the running speed of said engine from said command engine speed;

switch means for selecting one of said reference control signal and a speed control signal which is composed of said reference control signal and said speed correction signal;

flow rate control means for controlling the flow rate of intake air supplied to said engine, in accordance with the signal selected by said switch means;

auxiliary flow rate control means for effecting control, when said reference control signal has been selected by said switch means, the flow rate of the intake air being in accordance with the engine speed, and independently of said flow rate control means, so as to adjust said engine speed to a predetermined value; and ambient air temperature sensing means for delivering an ambient air temperature signal to said reference control amount output circuit means so as to vary said reference control signal in accordance with a change in the ambient air temperature.

* * * * *